US005197239A

United States Patent [19]

Glynn et al.

[11] Patent Number: 5,197,239

[45] Date of Patent: Mar. 30, 1993

[54] CONTAINMENT SYSTEM

[75] Inventors: William T. Glynn, West Suffield; John Rexroad, Lyme; David S. Denny, Middle Haddam, all of Conn.

[73] Assignee: SINCO Incorporated, East Hampton, Conn.

[21] Appl. No.: 699,963

[22] Filed: May 14, 1991

[51] Int. Cl.[5] ..... E04G 21/00

[52] U.S. Cl. ..... 52/63; 52/DIG. 12; 52/222; 52/282; 52/71; 160/84.1

[58] Field of Search ..... 52/63, 71, 222, 282, 52/DIG. 12; 160/84.1

[56] References Cited

U.S. PATENT DOCUMENTS 3,952,788 4/1976 Scholer ..... 160/84 R 4,815,562 3/1989 Denny et al. ..... 52/63

*Primary Examiner*—Richard E. Chilcot, Jr.

*Assistant Examiner*—Wynn E. Wood

*Attorney, Agent, or Firm*—Chilton, Alix & Van Kirk

[57] ABSTRACT

A containment system employs a pair of spaced webs and a cord which is laced through grommets mounted to the webs for adjusting the effective dimensions of the containment panels at the work site. Panels are connectable in end-to-end fashion wherein a panel flap extends between the panels with each of the panels being fastened to a support cable, so that there is no containment gap between panels of the containment system.

20 Claims, 3 Drawing Sheets

CONTAINMENT SYSTEM

BACKGROUND OF THE INVENTION

This invention relates generally to containment panels which are installed at construction and/or rehabilitation projects. More particularly, the present invention relates to containment net systems which are assembled from multiple panel modules.

Containment systems have long been employed at construction projects for containing paint, sandblasting residues and other materials to thereby ensure safety to individuals below the work locations and the environment by preventing material from accidentally falling off the construction structure. The containment systems conventionally are manufactured in standard panels which are secured to cables or horizontally positioned personnel nets by hooks, clips and other fastening hardware. Typically, the containment panels have a peripheral reinforced border formed by a nylon web or similar materials. Linear series of equidistantly spaced grommets are mounted along the web to form reinforced openings for attaching and securing the containment panels.

While conventional containment panel systems have proved to be successful from a containment perspective, the unique dimensional constraints presented by a given construction/rehabilitation project are frequently not readily accommodated by the standard dimensioned panels. As a construction or rehabilitation project progresses, readjustment of the containment system to accommodate different dimensional configurations may be required. In addition, when the containment panels are mounted in end-to-end relationship, either vertically or horizontally, there may be gaps between the adjacent ends. The gaps jeopardize the containment integrity of the overall containment panel system.

SUMMARY OF THE INVENTION

Briefly stated, the invention in a preferred form is a containment system which incorporates a means for adjusting the effective dimensions of a containment panel to the given requirements at the work site. The system employs a flexible containment panel having opposing ends. A pair of webs extend generally parallel to one of the ends. Each of the webs mounts a linear series of grommets which define openings. A cord is laced through the openings in an alternating corset-type fashion. At the work site, the effective dimensions of the panel may be adjusted by pulling the cord to adjust the effective spacing between the webs and therefore tighten the containment panel to assume the desired effective dimension.

In addition, the containment system employs a pair of containment panel modules which cooperate to form an overlapping connection between the panels. A web is attached at one end of the first containment panel. Grommets are mounted to the web to form a linear series of openings. The first panel is folded along a strip disposed between the first and second ends. The strip has a second series of grommets which form a second series of openings. The second end of the first containment panel module mounts a series of clips which connect the second end with another module.

The second containment panel module has a pair of opposing ends and a web mounted at each of the ends. A linear series of openings are disposed at each of the end webs. The second panel module is folded along a strip disposed between the first and second ends. A second series of clips, which are releaseably engageable with the first series of clips, are attached along the strip.

The two containment panel modules are connected in end-to-end relationship by engaging opposing corresponding pairs of clips of the first and second modules and attaching the modules to a cable by means of various fasteners connecting through the first module strip grommet openings and the second module end grommet openings so that a flap-like panel portion surrounds one side of the cable connection.

An object of the invention is to provide a new and improved containment system.

Another object of the invention is to provide a new and improved containment system wherein the effective dimensions of the standard containment panels may be readily adjusted at the work site.

A further object of the invention is to provide a new and improved containment system wherein standard net containment panels may be efficiently connected without imposing a containment gap between the connecting portions of the panels.

Other objects and advantages of the invention will become apparent from the drawings and the specification.

DETAILED DESCRIPTION OF THE PREFERRED EMBODIMENT

Figure 1:
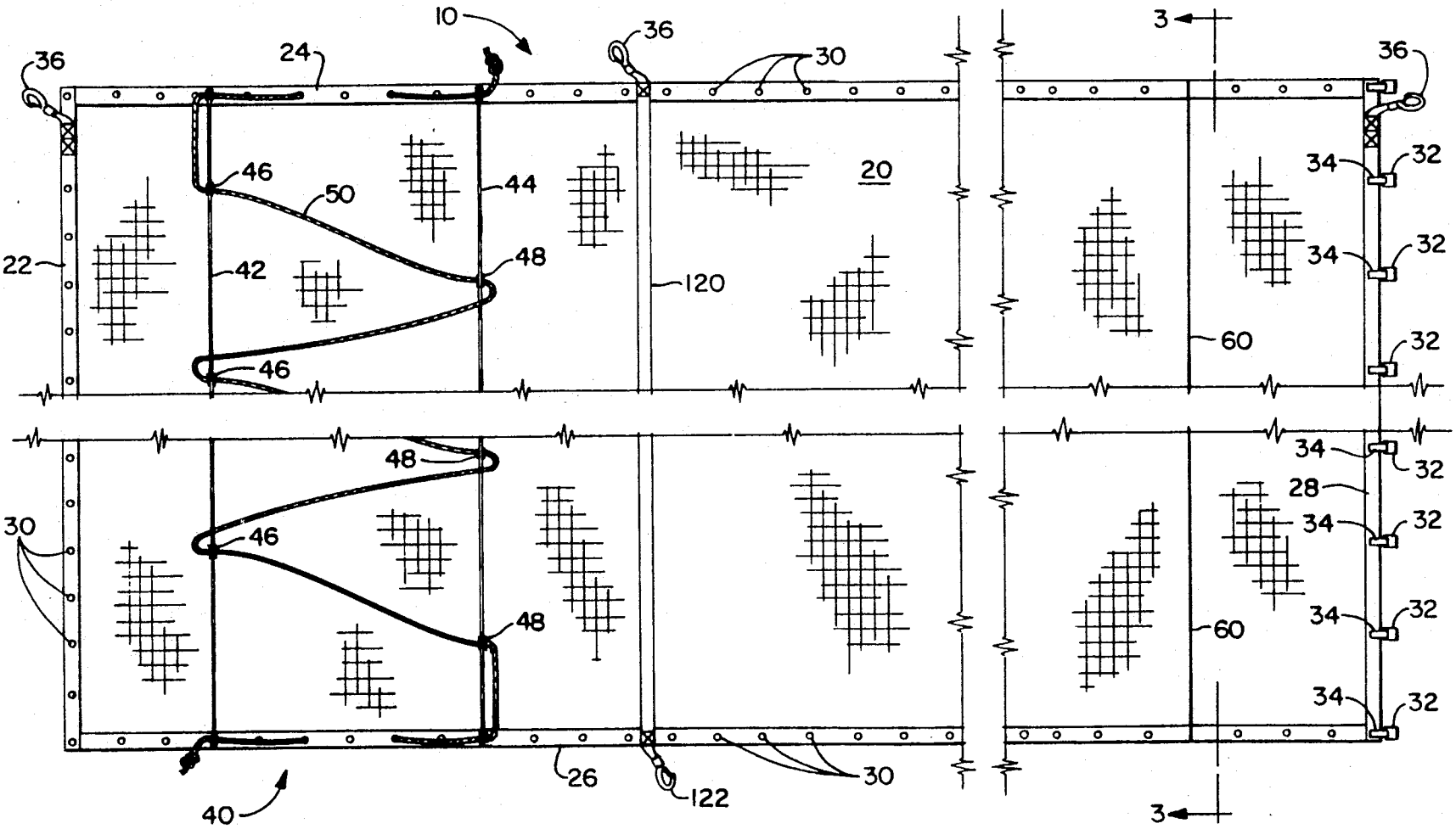
FIG. 1 is a side elevational view, partly broken away, of a first containment panel in accordance with the present invention.
Figure 2:
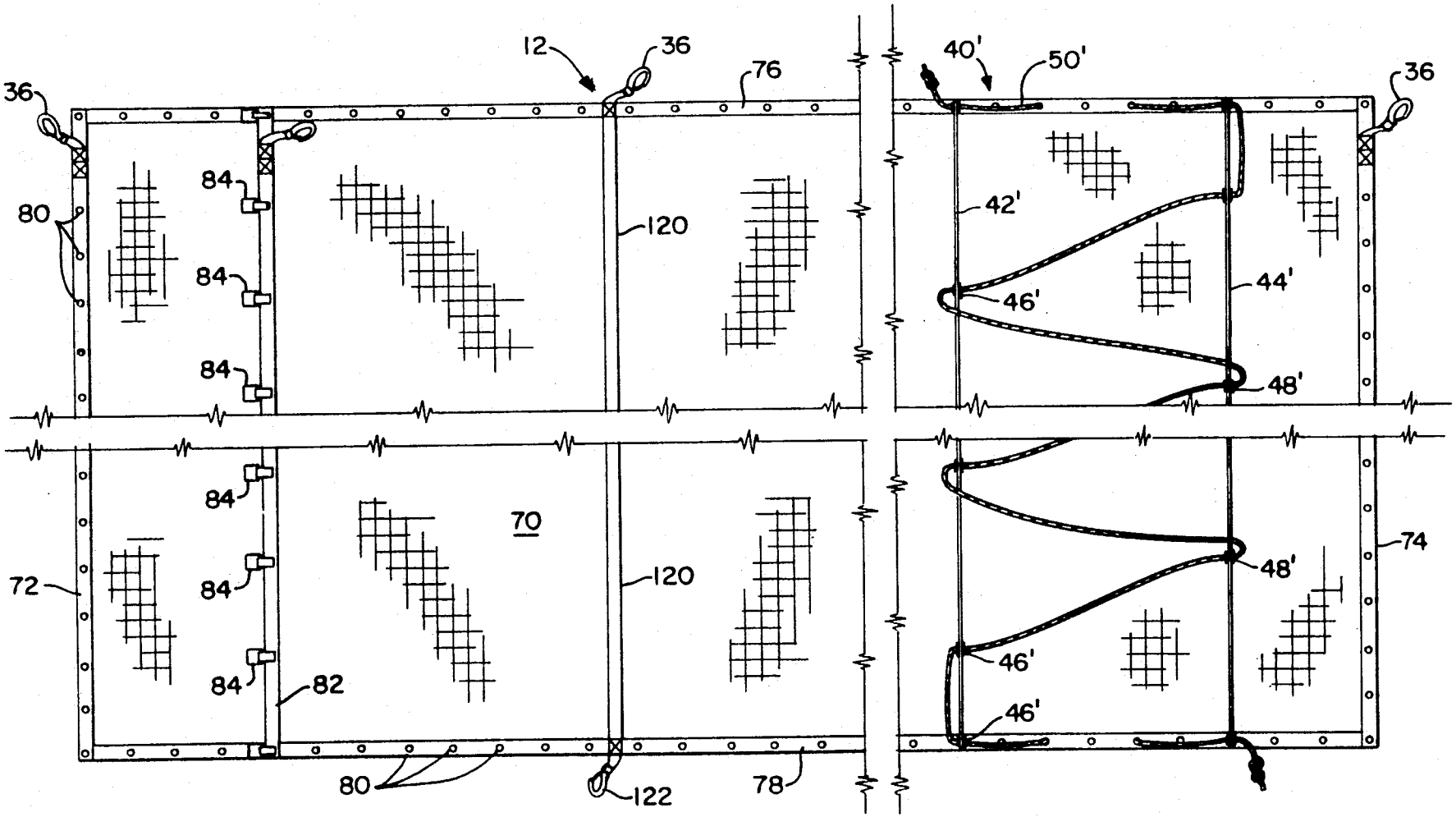
FIG. 2 is a side elevational view, partly broken away, of a second containment panel in accordance with the present invention.

With reference to the drawings wherein like numerals represent like parts throughout the figures, a containment system in accordance with the present invention employs a plurality of containment panel modules of at least two standard types designated generally by the numeral 10 (FIG. 1) and 12 (FIG. 2). The containment system is formed by mounting the containment panel modules 10 and 12 to a construction structure, such as a bridge, a dam or other elevated structure (not illustrated). The containment system functions to contain debris and other materials so as to prevent the debris and material escaping from the structure during the construction process. A given structure may employ numerous containment panel modules which are typically suspended between cables 16 and anchored thereto or are attached to the top side of horizontally positioned personnel nets. In one preferred form, the containment system is comprised of a multiplicity of substantially identical containment modules 10 and substantially identical modules 12, so that the containment system is essentially assembled in a modular fashion.

With reference to FIG. 1, containment panel module 10 comprises a flexible rectangular panel 20 which may be a mesh net formed of polyester material or polypropylene, a nylon canvas, a solid mesh material or a tarp. In one embodiment, the panel is a PR20 polyester mesh net which has dimensions of approximately 45 ft.×26 ft. Naturally, other dimensions are possible. The borders of the net 20 are reinforced by overlapping strips of nylon webbing material 22,24 26,28 which are stitched together to form 2 inch border strips. Other flexible reinforcement materials may also be employed. Linear rows of equidistantly spaced metal grommets 30 are mounted to the border webbings 22,24,26 at six inch center spacings. Central openings through the grommets 30 facilitate attachment of the panel to the base structure or the border of another panel. A plurality of clips 32 are spaced approximately one foot apart and are securely attached to the end border webbing 28 via straps 34. A safety hook 36 with a spring loaded keeper is also anchored at an upper end location to border webbings 22 and 28 for securing the panel to a structure.

A width adjustment subassembly 40 comprises a pair of laterally spaced webs 42,44, which extend between border webs 24,26 and are positioned in generally parallel relationship to border web 22. Webs 42 and 44 are spaced approximately 3 ft. apart in one embodiment. The webs 42,44 are typically manufactured from nylon webbing material which is folded over to form a 2 inch strip. The webs are stitched to the upper and lower webs 24,26 and the panel 20. Metal grommets 46 are mounted to web 42 to form a plurality of eyelets. The eyelets are spaced at approximate 2 feet on center spacings except for the upper eyelet which is approximately 1 foot from the next upper eyelet. The web 44, likewise, has a series of metal grommets 48 which are positioned to form an alternating series of eyelets which are 2 feet on center and vertically alternate relative to the eyelets defined by the grommets of web 42.

A cord 50 laces through the eyelet of upper grommet 48 and one or more intervening corresponding openings of the upper border webbing 24, through the eyelet of upper grommet 46 and criss-crosses through the opposed eyelets of webs 42,44 in alternating fashion so as to form a corset-like configuration which terminates with the cord being drawn through the lower eyelets of webs 42,44 and through intermediate grommet openings of the lower border web 26. The spacing between the webs 42,44 may be adjusted by pulling on cord 50 to draw the webs toward each other to thereby adjust the effective width of the module. The ends of the cord 50 may then be tied off at the desired web spacing position.

Figure 3:
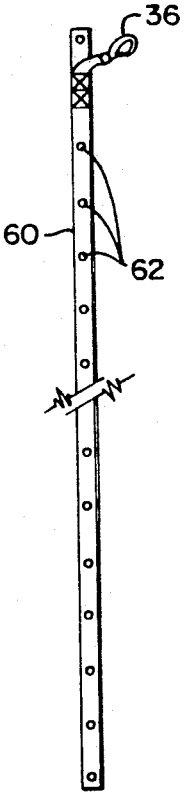
FIG. 3 is an end sectional view, partly broken away, of a portion of the panel of FIG. 1 taken along the line 3—3 thereof.

A nylon web 60, which may be a 2 inch overlap nylon material, is fastened general in parallel relationship to the end web 28 at approximately 2 ft. from border web 28. The panel 20 may be folded and the web stitched along the fold. With reference to FIG. 3, web 60 also includes a plurality of grommets 62 which are equidistantly spaced in approximately 6 inch on center relationship so as to form an intermediate series of attachment openings. A hook 36 is anchored to web 60.

With reference to FIG. 2, containment panel module 12 comprises a panel 70 which is similar in form and function to that of panel 20. The panel includes opposed reinforced side border webs 72,74 and upper and lower border webs 76,78 which traverse the rectangular border of the panel. Grommets 80 are mounted at 6 inch on center locations along the foregoing border webs to define multiple attachment openings. A clip web 82 is mounted approximately 2 ft. from end border web 72 in general parallel disposition thereto. Web 82 extends from border web 76 to border web 78.

Figure 5:
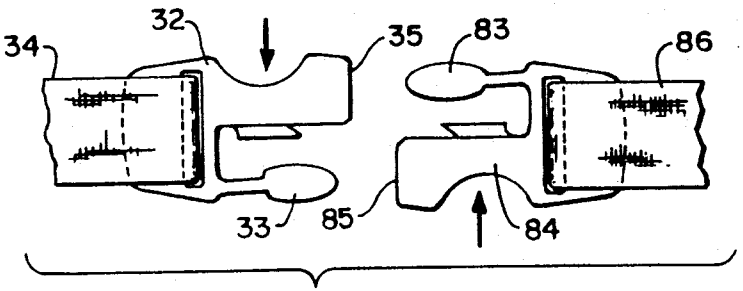
FIG. 5 is an enlarged exploded view illustrating the clips employed in the connection of FIG. 4.

A plurality of clips 84 are anchored to the web via straps at approximate 1 foot equidistantly spaced locations. The clips 84 are configured and positioned for interlocking engagement with the clips 32 of panel 10. The corresponding clips 84,32 may assume numerous forms. As best illustrated in FIG. 5, the clips preferably comprise respective complementary semi-flexible tongues 33,83 and slots 35,85 which mutually interlock by virtue of a catch interposed in each slot capturing an inserted tongue. The clips release upon transverse manual gripping or compression of the clips in the direction of the arrows to force the tongues from the catches.

An adjustment subassembly 40' is generally a mirror image of subassembly 40 and comprises a pair of parallel webs 42',44', which are mounted and secured to the panel 70 and the upper and lower border webs 76,78 at approximately 3 ft. equidistant spacing. Web 42' carries a plurality of grommets 46 which are disposed at approximately 2 feet spacings except for the lower grommet which is spaced one foot from the next lower grommet. Likewise a second set of grommets 48' is mounted to the web 44' so as to define arrays of corresponding eyelets which are spaced in generally alternating relationship. A cord 150' extends through the upper web openings and laces back and forth in criss-cross fashion through the alternating eyelets of the first and second webs in a corset-like fashion.

The adjustment subassemblies 40,40' function so that the effective width of the panels and the containment envelope may be adjusted on site after the panels are installed. After the ends of the containment panels are mounted, as will be described below, the cords 50,50' are pulled to thereby effectively reduce the distance between the webs 42,44 and 42'44' and effectively reduce the containment envelope to conform with the dimensional constraints at the given work site structure. The adjustment subassemblies 40,40' may also be employed to tighten the panels during the construction project. The containment panels may tend to sag over time and may be structurally susceptible to high wind conditions if the sagging condition is not remedied.

Various distances or spacings may be implemented between the adjustment webs 42,44 and 42',44'. In one embodiment wherein the panel has a width of approximately 26 ft., the containment panel is adjustable to an effective width which ranges from 23 to approximately 26 ft. It should be appreciated that the adjustment features may be implemented in a vertical disposition, so that, for example, the effective height of the panels may varied. In addition, it should be appreciated that multiple vertical and horizontal adjustment subassemblies may be incorporated into a single containment panel module.

With reference to FIGS. 1 and 2, additional vertical reinforcement strips 120 (only one illustrated in each of the FIGS. 1 and 2) of webbing material may be attached to the panels approximately every 10 feet to distribute any wind loading and to provide additional anchorage and connection points. A hook 36 may be mounted at the top of each vertical reinforcement strip 120. A loop 122 formed from webbing material is positioned at the bottom of the vertical strip 120. The hooks 36 may be employed for lifting the panel at the panel top and/or clipping to loops 122 of other panels.

Figure 4:
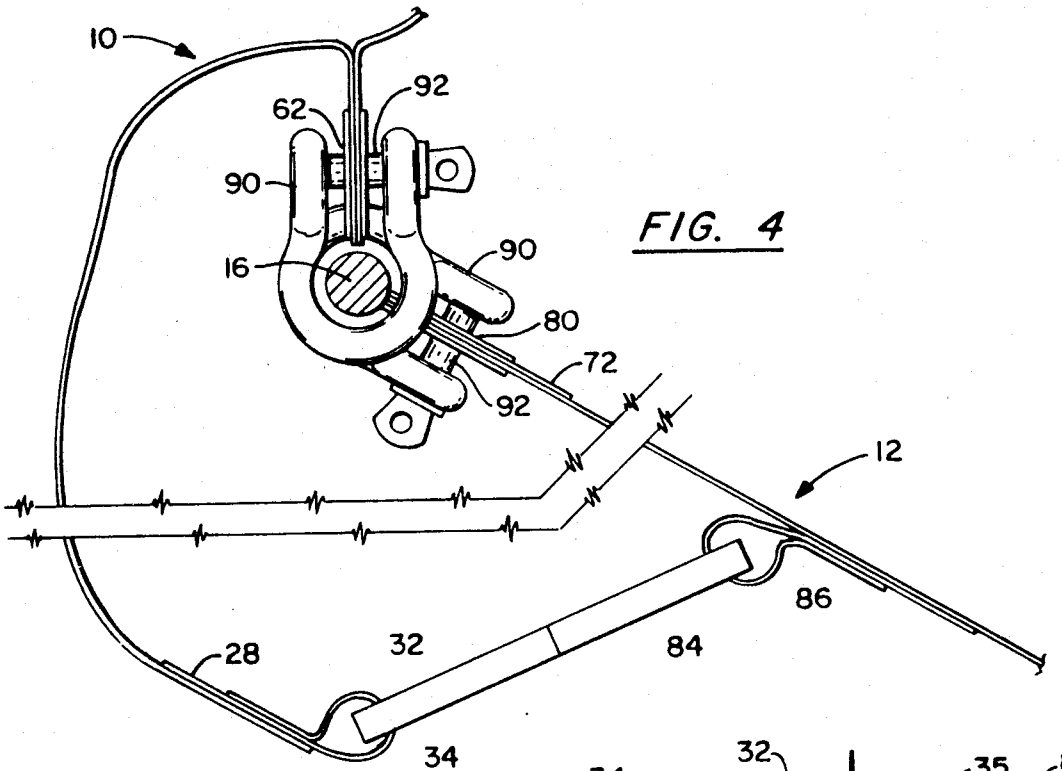
FIG. 4 is a top sectional view, partly broken away, illustrating a connection for the containment panels of FIG. 1 and FIG. 2.

With reference to FIG. 4, the panels or modules 10,12 are connected by essentially aligning the panels and connecting the corresponding pairs of clips 32,84 as best illustrated in FIG. 4. The panel portion adjacent webs 60 and 28 of module 10 is joined to the panel portion adjacent webs 72 and 82 of module 12. Containment panel 10 is also attached to the cable through the openings of grommets 62 of the intermediate web 60 by means of screw pin shackles 90. The shackles 90 partially encircle the cable 16 and mount the panel via pins 92 inserted through the grommets openings. The end of the containment panel 12 is likewise mounted to the cable 16 and attached in place by screw pin shackles 90 which are inserted through grommets 80 of border web 72. Connections are preferably implemented for each corresponding grommets 62 and 80 and clips 32 and 84. Alternately, hooks, clips or connectors other than clips 32 and 84 may be employed. Consequently, as best illustrated in FIG. 5, there is no gap between the connecting adjacent portions of containment panel modules 10 and 12, and a small flap-like covering 100 encloses the module connections with the cable 16 so that an effective containment envelope of high integrity is thereby implemented—even at the connecting portions of the containment net system.

It should be appreciated that a similar connection would be implemented in alternating fashion between additional containment panel modules 10 and 12 as may be required for containment net installation. The adjacent panels or net seams of the containment system are thus effectively covered in a very efficient manner. In addition, it should be appreciated that the connection system illustrated in FIG. 4 may be implemented for a vertical cable orientation (not illustrated).

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A containment system comprising:

flexible containment panel means having a first end and an opposing laterally spaced second end;

first web means mounted to said panels means and extending generally transversely to said panel means, said first web means defining a first plurality of eyelets;

second web means mounted to said panel means and laterally spaced from said first web means, said second web means extending generally transversely to said panel means and defining a second plurality of eyelets; and a cord receivable through said first and second eyelets in alternating fashion wherein the effective lateral dimension of said panel means may be adjusted by pulling on said cord to thereby selectively adjust the lateral spacing between said first and second web means.

2. The containment system of claim 1 wherein said first and second eyelets are defined by a plurality of grommets mounted to said first and second web means.

3. The containment system of claim 1 wherein said eyelets are generally uniformly alternately transversely spaced along said first and second web means.

4. The containment system of claim 1 wherein said first and second web means are equidistantly spaced approximately 3 feet and eyelets of each said first and second plurality of eyelets are spaced approximately 2 feet.

5. The containment system of claim 1 further comprising border means comprising a nylon strip of webbing material attached at the peripheral portions of said panel means.

6. The containment system of claim 1 wherein said panel means comprises a substantially rectangular polyester mesh containment panel.

7. The containment system of claim 6 wherein said first and second web means are formed from strips of nylon webbing material which extend in generally parallel relationship to said first and second ends.

8. A containment system comprising:

a first containment panel having a first end and a laterally spaced opposing second end, a first web mounted at said first end and defining a first series of openings, second opening means for defining a second series of transversely spaced openings disposed between said first and second ends and a first series of transversely spaced connector means attached at said second end;

a second containment panel having a first end and a laterally spaced opposing second end, a first and a second web mounted at said ends and defining a series of openings, a second series of transversely spaced connector means disposed between said first and second ends and releaseably engageable with said first series of connector means; and a cable, said first containment panel being attached to said cable by fastener means inserted through said second series of openings, and said second containment panel being secured to said cable by means of fastener means inserted between said first series of openings of said first end of said second containment panel, and said first series of connector means being engaged with said second series of connector means, wherein a flap portion of said first containment panel between said second series of openings and said second end extends at one side of said cable and connects with said second containment panel by means of said first and second connector means.

9. The containment system of claim 8 wherein said fastener means are screw pin shackles.

10. The containment system of claim 8 wherein said openings are defined by grommets.

11. The containment system of claim 8 wherein each said first and second connector means comprise clips and said first series of clips each have a tongue and a slot catch engagement which is complementary with a corresponding tongue and slot catch engagement of said second series of clips, and said engaged clips are releasable upon application of a compressive force thereof.

12. The containment system of claim 8 wherein said first panel is folded along a transverse strip, webbing material is mounted to said first panel along said strip, and said second series of openings is defined by grommets mounted to said webbing material.

13. The containment system of claim 8 further comprising a webbing strip mounted to said second panel and extending transversely thereto, said second series of connector means being attached to said strip.

14. The containment system of claim 8 wherein at least one of said containment panels has adjustment means for variably adjusting the distance between laterally spaced portions of said at least one panel.

15. The containment system of claim 14 wherein said adjustment means further comprises eyelet means for defining two laterally spaced series of eyelets and a cord laced through said eyelets.

16. The containment system of claim 15 wherein each said first and second panels has a said adjustment means.

17. A containment system comprising:

flexible rectangular containment means having a first end and an opposing laterally spaced second end; and adjustment means for adjusting the lateral spacing between portions of said containment means comprising:

first eyelet means for defining a first series of transversely spaced eyelets disposed generally parallel to said first end;

second eyelet means for defining a second series of transversely spaced eyelets disposed generally parallel to said first end and laterally spaced from said first eyelet means;

cord means comprising a cord extending through said first and second eyelets wherein said cord is tightenable to define the lateral spacing between said first and second eyelet means.

18. The containment system of claim 17 wherein said first series and second series of eyelets are positioned in alternating relationship and said cord is laced through said eyelets in criss-cross fashion.

19. The containment system of claim 17 further comprising a pair of flexible reinforcement member mounted to said containment means, and said first and second eyelet means comprise grommets mounted to said reinforcement members.

20. The containment system of claim 19 wherein said containment means is a net and said reinforcement members comprise webs which are manufactured from strips of nylon material stitched to said net.

* * * * *